United States Patent [19]

Haug

[11] Patent Number: 4,788,623

[45] Date of Patent: Nov. 29, 1988

[54] KEY OPERATED MECHANISM FOR PRODUCING CODED SIGNAL COMBINATIONS FOR SELECTING A FUNCTION OF A MULTIFUNCTIONAL DEVICE

[75] Inventor: Werner Haug, Langnau, Switzerland

[73] Assignee: Frama AG, Lauperswil, Switzerland

[21] Appl. No.: 135,277

[22] Filed: Dec. 24, 1987

Related U.S. Application Data

[63] Continuation of Ser. No. 903,768, Aug. 29, 1986, abandoned.

[30] Foreign Application Priority Data

Sep. 12, 1985 [CH] Switzerland ..... 03941/85

[51] Int. Cl.[4] ..... E05B 27/00; H01H 47/00

[52] U.S. Cl. ..... 361/171; 70/413; 335/206; 335/207

[58] Field of Search ..... 200/61.64–61.68; 335/205–207; 70/276, 278, 413; 340/825.31–825.32, 825.35; 361/171, 172

[56] References Cited

U.S. PATENT DOCUMENTS

| | | | |
|---|---|---|---|
| 2,767,278 | 10/1956 | Collins | 335/206 |
| 3,705,369 | 12/1972 | Schwendeman, Jr. | 335/206 |
| 4,317,156 | 2/1982 | Stangl | 70/413 X |
| 4,331,013 | 5/1982 | Jaulmes | 335/207 X |
| 4,380,162 | 4/1983 | Woolfson | 70/413 X |
| 4,392,134 | 7/1983 | Lutz | 70/413 X |
| 4,554,422 | 11/1985 | Embrey et al. | 335/206 X |
| 4,562,711 | 1/1986 | Fliege | 70/413 X |

*Primary Examiner*—J. R. Scott
*Attorney, Agent, or Firm*—Ladas & Parry

[57] ABSTRACT

This invention pertains to a key operated mechanism for producing coded signal combinations for selecting a function of a multifunctional device. The mechanism includes a plurality of magnetically operated switches arranged along a key guide. The key includes magnets specifically positioned for interaction with the magnetically operated switches in accordance with a code diagram. Closing of the switches sends signals to a code signal user, which if the signals are enabling activates an associated machine such as a franking machine.

9 Claims, 2 Drawing Sheets

| KEY NO. → | "0" | "1" | "2" | "3" | "4" | "5" | "6" | "7" |
|---|---|---|---|---|---|---|---|---|
| HOLE A | | N | | S | | N | | S |
| HOLE B | | | S | S | | | S | S |
| HOLE C | | | | | S | S | S | S |
| HOLE D | N | N | N | N | N | N | N | N |

Fig.3
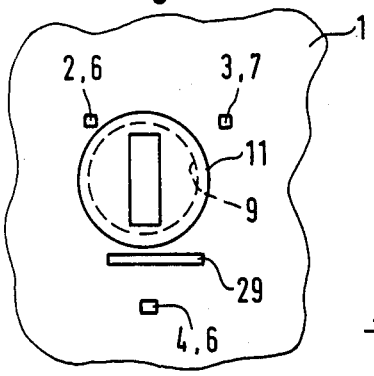
Fig.4
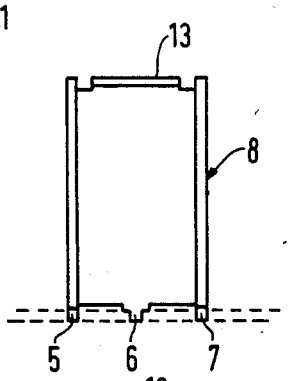
Fig.6
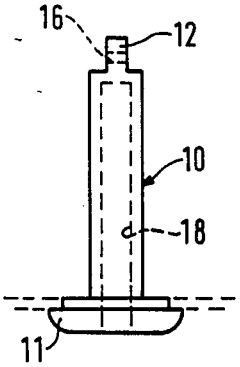
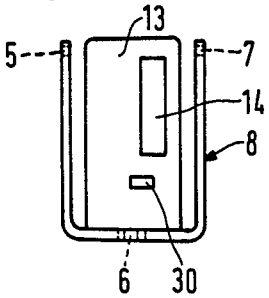
Fig.5
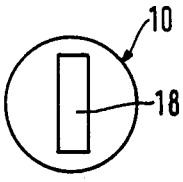
Fig.7
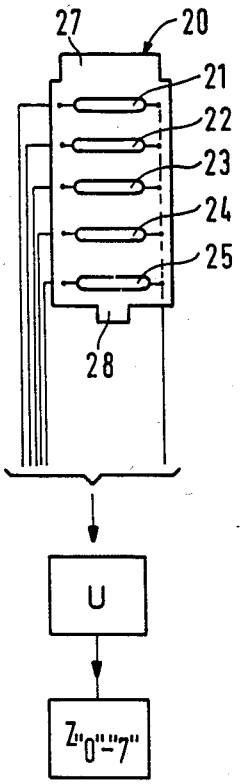
Fig.8
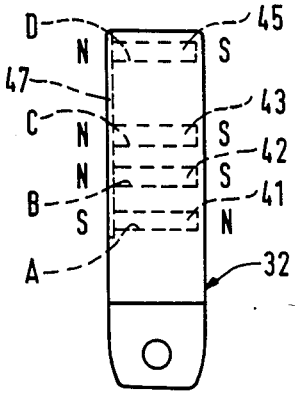
Fig.9
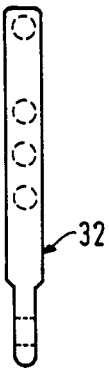
Fig.10

KEY OPERATED MECHANISM FOR PRODUCING CODED SIGNAL COMBINATIONS FOR SELECTING A FUNCTION OF A MULTIFUNCTIONAL DEVICE

This application is a continuation of application Ser. No. 06/903,768, filed Aug. 29, 1986, now abandoned.

BACKGROUND OF THE INVENTION

The present invention relates to a new and improved construction of a key-operated, electrical switching device with magnets enclosed in series in a key body and a key guide connected to the switching device casing and along which is arranged a row of electrical switching contacts operable by the magnets, it being possible to produce a predetermined electrical main connection through the magnetic operation of at least that contact located in the final position in the row in the key insertion direction, whilst in the penultimate position in the row is provided a magnetically operable blocking contact.

A switching device of this type is known from U.S. Pat. No. 4,331,013 and fulfils the switching in theft-proof manner the circuit of the electrical system of a motor vehicle. For this purpose the casing of the known device contains a plurality of equidistantly spaced magnet-operated switches and for making the desired electrical connection only the switches selected by the electrical circuit diagram in accordance with a coded diagram are switched on, so that permanent magnets invisibly enclosed within the key body have to be provided at the appropriate position for the same. This connection remains interrupted on operating also provided magnet-operated switches, which have not been selected for producing this connection.

SUMMARY OF THE INVENTION

It is an object of the present invention to provide a device of the mentioned type which, in the case of a simple, inexpensively manufacturable and space-saving construction, permits a reliable and confusion-proof, random switching of different electrical connections by different keys.

In order to implement this object of the invention in accordance with the invention the device is operable by differently coded keys for performing a corresponding number of different electrical main connections, the electrical contacts being electrically connected to a code signal user, which performs a connection to a consuming means in accordance with the code of the key used.

As a result of its high reliability, the device according to the invention is particularly suitable for the selective electrical connecting in of different counters for the value consumption of an electronically controlled franking machine, making it possible to show the individual value consumption of different users, who in each case have a different key.

Advantageous embodiments of the invention form the subject of dependent claims.

BRIEF DESCRIPTION OF THE DRAWINGS

The invention is described in greater detail hereinafter relative to a non-limitative embodiment and the attached drawings, wherein shown is:

FIG. 3 as a view of part of a franking machine casing plate receiving the switching device;

FIG. 4 as a plan view of the steel casing of the switching device;

FIG. 5 as a front view of the steel casing according to FIG. 4;

FIG. 6 as a plan view of an inner casing for the key guide;

FIG. 7 as a front view of the inner casing according to FIG. 6;

FIG. 8 as a plan view of a circuit board carrying a solenoid-operated switch with diagrammatically indicated electronic units;

FIG. 9 as a plan view of a key provided for the switching device; and

FIG. 10 as a narrow-side view of the key of FIG. 9.

DETAILED DESCRIPTION OF THE PREFERRED EMBODIMENT

Figures 1, 2:
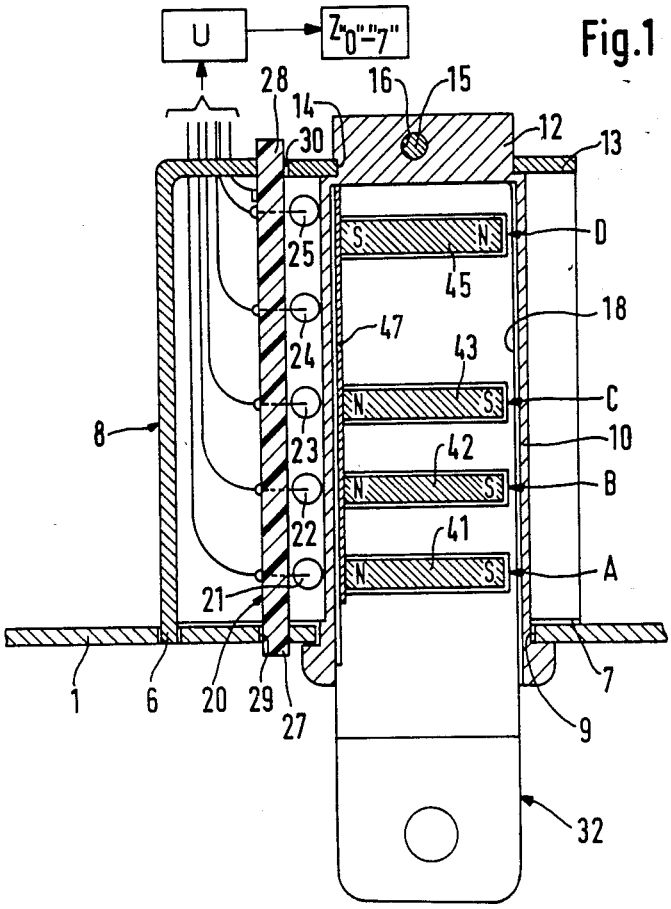
FIG. 1 as a larger scale view of an elongated slot through a switching device according to the invention positioned parallel to the keyhole slot plane.
FIG. 2 as a diagram showing different key codes.

The device shown in FIG. 1 is fixed to a casing plate 1 of a not-shown franking machine. For this purpose the casing plate 1 has three small openings 2, 3, 4 for the engagement of extensions 5, 6, 7 of a cross-sectionly U-shaped steel casing 8 of the switching device, as well as a circular opening 9, through which is introduced the inner casing 10 used for key guidance purposes and shown in FIGS. 6 and 7. Inner casing 10 holds the switching device on casing plate 1, in that a collar 11 shaped on to the inner casing 10 engages along the edge of said opening 9 with the outer face of casing plate 1 and on the rear end of inner casing 10 is shaped an extension 12, which is connected to a rear wall 13 of steel casing 8. For the purpose of this connection, extension 12 extends through a correspondingly shaped opening 14 and carries a locking pin 15, which passes through a transverse bore 16 of the extension located behind wall 13 and consequently engages on the outside of said wall. After the removal of said locking pin the complete device can be raised from casing plate 1 and permits a simple, rapid fitting of the device.

For mounting an electric circuit board 20 carrying the magnetic-switches (dry reed contacts) 21 to 25 between the rear wall 13 of steel casing 8 and the casing plate 1 of the franking machine, plate extensions 27, 28 are provided at the front and rear end of said circuit board 20 and engage in correspondingly shaped openings 29, 30 defined in casing plate 1 and partition 13, if steel casing 8 is mounted by means of inner casing 10 on casing plate 1 in the manner described hereinbefore. Instead of openings 2, 3, 4, and 29, 30, depressions could be provided in casing plate 1 to receive the extensions 5, 6, 7 and plate extensions 27, 28.

Key 32 which, like inner casing 10, is made from a plastics material or some other material which does not influence the magnetic fields, comprises an elongated plate with planar outer faces and, in not shown manner, encloses at least one pin-like permanent magnet. When there are five magnetic switches 21 to 25, a maximum of four permanent magnets 41 to 43 and 45 are used. For this purpose, key 32 has receiving bores A, B, C, D for the pin-like permanent magnets, which extend in the plane of the key at right angles to the longitudinal direction thereof. Following the filling of certain receiving bores in accordance with the code diagram shown in FIG. 2, they are tightly closed or sealed by means of a common closing web 47, by welding the same to the key body. The planar outer faces of the key body can, for example, carry representations or letters, so that it can be used in the same way as a key pendant or advertising means.

The code diagram reveals that each of eight different keys with the numbers "0" to "7" in hole D, located at the rear end of key 32, has a magnet 45 corresponding to the condition provided in the code signal user U that the device only produces an electrical connection to the franking machine counters Z "0" to "7" when one of the rear solenoid-operated switch in the key insertion direction is operated by magnet 45.

To ensure that an electrical connection is only produced or through the arrangement of magnetically-operated switches 21 to 23 and 25 only a usable signal combination is supplied to the code signal user U when key 32 has assumed an exactly predetermined end position in the key receiving hole 18 corresponding to FIG. 1, the rear magnet 45 is located in said end or abutment position of key 32 to the rear magnetically operated switch 25 in the predisplaced switch position, whilst the other magnets 41 to 43 or the receiving bores A, B, C for the same precisely face the associated magnetically-operated switches, for example, with the minimum spacing. The aforementioned predisplaced switch position corresponds to that position of magnet 45 which just still reliably ensures a switching of magnetically-operated switch 25 by the force of the magnetic field of magnet 45. This displaced switch position is, for example, obtained in that between the rear magnetically-operated switches 24, 25 or also between the magnetically-operated switches 23, 24, a larger spacing is provided than between the three front magnetically-operated switches 21 to 23, whilst between the penultimate and last magnets 43, 45 a spacing is provided which, due to the gap between them, is twice as large as the spacing between magnets 41 and 43. For example, the spacings between magnets 41 to 43 or their receiving holes and correspondingly the spacings between the magnetically-operated switches 21 to 23 are in each case 7 mm, whilst the spacing between the three rear magnetically-operated switches 23 to 25 is in each case 8 mm and the spacing between the two rear magnets 43 and 45 is 14 mm.

Great significance for a reliable operation of the device according to the invention is attached to ensuring a precisely predetermined switch position of key 32 in key receiving hole 18, due to the sensitively responding magnetically-operated switches (dry reed contacts) and the dispersion of the different, also reciprocally influencing magnetic fields.

In order to ensure with maximum certainty that the fields of the magnets do not reciprocally influence one another and to permit a more compact arrangement of the magnets, they are preferably arranged in alternating manner with opposite polarity, as is shown by the reverse arrangement of magnet 45 in FIG. 1.

It has surprisingly been found that if the magnetically-operated switches 21 to 25 are not at least partly surrounded by a steel casing 8, there is an extensive reciprocal influencing between the individual magnets with respect to their locally directed switching action with corresponding faulty switching operations. Thus, in preferred manner according to the invention, the device has a steel casing 8 with ferromagnetic characteristics which, due to its U-shaped cross-section, surrounds the switches 21 to 25 to three sides.

In order to ensure no unauthorized use of the franking machine or an unauthorized electrical connection by means of the device, at the penultimate position, for example, upstream of the rear magnetically-operated switch is provided a magnetically-operated switch 24 serving as an inhibiting switch and whereby on closing the same, an inhibit signal is supplied to the code signal user U. When an unauthorized attempt is made by a foreign magnet to operate the magnetically-operated switch 25 and whose operation is necessary for any electrical main connection of the device, said inhibiting magnetically-operated switch 24 is also operated.

The code diagram for keys with numbers "0" to "7" shown in FIG. 2 illustrates the occupancy by magnets of the receiving holes A, B, C, and D provided in key 32 and also their polarity by indicating the south pole S or north pole N directed towards one side of key 32. For example a key no. "5" in hole A, C, and D has in each case one magnet 41, 43, 45 with the same polarity of the magnets in hole A and D. The code signal user U stores certain signal combinations of magnetically-operated switches 21 to 23 and 25 corresponding to the code and when they are supplied to the code signal user U, as a result of the switching of a particular combination of switches 21 to 23 and 25 in accordance with the particular key code, an electrical connection is freed or cleared to the consuming means to one of the franking machine counters Z "0"–"7" in the present example.

It is obvious that a device according to the invention has many advantageous possible uses as a result of its simple construction and reliable operation, for example, also as a locking means on doors or container covers highly exposed to the influence of the weather, because no dirt or wetness can pass to the electrical switching connections via the key receiving hole 18 and it is also possible to completely encapsulate the same in waterproof, simple manner.

Due to the fact that the inner casing 10, which acts as the key guide as well as the circuit board 20 carrying the magnetically-operated switches, are at the front and rear in each case maintained on an identical part, such as the casing wall 13 and the front casing plate 1, a precisely predetermined spacing between the key 32 or its magnets and the magnetically-operated switches is always ensured and this is very important for reliable switching purposes. Thus, this spacing can also not be altered by lateral force actions on key 32.

The device is preferably located in an area of a casing plate 1, which is horizontal or sloping, so that it leads to a downwardly sloping or vertical alignment of the key guide, such as the inner casing 10. This has the advantage that under the influence of gravity, the key is reliably held in its rear abutment position and consequently locking means are superfluous.

What is claimed is:

1. A key operated mechanism for producing coded signal combinations for selecting a function of a multifunctional device, said mechanism comprising:

a keyguide having a rear abutment;

circuitry associated with said keyguide;

a signal processing unit associated with said circuitry for receiving signals from said circuitry;

a plurality of magnetically operable switches located generally in a row and associated with said keyguide, said switches being connected to said circuitry and operable to send said signals through said circuitry, at least one of said switches operable to power said signal processing unit and at least a second of said switches operable to block the operation of said signal processing unit;

a key receivable in said keyguide;

a first magnet located on said key, said key being capable of enabling said mechanism by closing said first switch when said key abuts said rear abutment and said first magnet being located generally between said first and said second switch and in operable proximity to said first switch.

2. The mechanism of claim 1 wherein the magnets have a pin-like construction and are enclosed in said key at right angles to the longitudinal direction thereof.

3. The mechanism of claim 1, wherein said south pole of said first magnet lies near the north pole of said second magnet while the north pole of said first magnet lies near the south pole of said second magnet such that said first magnet provided in said key has an opposite polarity to that of said second magnet.

4. The mechanism of claim 1 further comprising a casing generally surrounding said magnetically operable switches said casing being made from ferromagnetic material.

5. The mechanism of claim 4, wherein the casing is made from a steel sheet being U-shaped in cross section and defining an opening for receiving said key guide.

6. The mechanism of claim 5, further comprising a circuit board located in said casing and near said opening, said circuit board holding said magnetically operable switches.

7. The mechanism of claim 1 wherein the key guide is oriented so that the key is held in its rear abutment position by gravity.

8. The mechanism of claim 1 further comprising a second magnet located on said key and operable with a third switch of said plurality of switches, the distance between said first magnet and said second magnet being greater than the distance between said first switch and said second switch but less than the distance between said first switch and said third switch.

9. The mechanism of claim 1 wherein said key guide is U-shaped in cross section and of a plastics material.

* * * * *